United States Patent [19]

Mills

[11] Patent Number: 4,899,988

[45] Date of Patent: Feb. 13, 1990

[54] FIBER OPTIC CABLE PLACING EQUIPMENT

[75] Inventor: Jeffrey L. Mills, Northville, Mich.

[73] Assignee: Madison lightwave Systems, Inc., Warren, Mich.

[21] Appl. No.: 139,127

[22] Filed: Dec. 23, 1987

Related U.S. Application Data

[63] Continuation of Ser. No. 770,316, Aug. 28, 1985, abandoned.

[51] Int. Cl.[4] ..... B65H 59/00; B66D 1/30

[52] U.S. Cl. ..... 254/292; 254/134.3 R; 254/374

[58] Field of Search ..... 254/374, 903, 263, 227, 254/134.3 FT, 329; 242/139

[56] References Cited

U.S. PATENT DOCUMENTS

| | | | |
|---|---|---|---|
| 42,864 | 5/1864 | Morgan | 254/374 X |
| 772,994 | 10/1904 | Wood . | |
| 1,435,059 | 11/1922 | Franzen | 254/263 |
| 1,437,681 | 12/1922 | Rathbun et al. . | |
| 2,023,790 | 12/1935 | Ormsby et al. | 254/329 |
| 2,378,749 | 6/1945 | Brown | 254/374 X |
| 2,449,376 | 9/1948 | Gahagan | 254/374 X |
| 2,896,911 | 7/1959 | Carpenter | 254/134.3 FT |
| 3,168,287 | 2/1965 | Parola | 254/330 X |
| 3,223,384 | 12/1965 | Gebo | 254/134.3 FT |
| 3,601,365 | 8/1971 | Hall | 254/134.3 |
| 4,291,864 | 9/1981 | Reynolds | 254/380 X |
| 4,456,225 | 6/1984 | Lucas | 254/134.3 FT |
| 4,575,050 | 3/1986 | Bechmann | 254/374 |
| 4,576,362 | 3/1986 | Langston | 254/134.3 |

*Primary Examiner*—Katherine A. Matecki

*Attorney, Agent, or Firm*—Harness, Dickey, Pierce

[57] ABSTRACT

The cable puller employs a conically tapered capstan and self-contained motor both carried on a readily collapsible and portable frame. The puller is adapted for placing inside of a manhole where the capstan is aligned with the duct through which the cable is to be pulled. Several such cable pullers may be operated in concert to pull a theoretically endless fiber optic cable at a controlled speed and without exceeding the tensile strength of the cable. Tension on the cable effects the frictional gripping force between the capstan and the cable looped there around and this gripping force controls the extent to which the cable is permitted to climb up and slip down the conical incline of the capstan to a point where equilibrium is reached. A radio-controlled sensor is provided at each pulling station to signal cable stoppage faults and to respond to faults signaled by other pulling stations by shut down of all stations until the fault is corrected.

16 Claims, 5 Drawing Sheets

FIBER OPTIC CABLE PLACING EQUIPMENT

This is a continuation of U.S. patent application Ser. No. 770,316, filed Aug. 28, 1985, entitled "Fiber Optic Cable Placing Equipment", now abandoned.

BACKGROUND AND SUMMARY OF THE INVENTION

The present invention relates generally to equipment for placing cables in ducts and more particularly to a portable cable placing system for pulling fiber optic cable through duct work without exceeding the cable's tensile strength. The invention is capable of handling theoretically endless lengths of cable using a plurality of appropriately spaced, individually powered puller devices so that the need to splice shorter lengths of cable is eliminated.

Fiber optic cable has been heralded as the telephone and data communication transmission line of the future. Among the advantages of fiber optic transmission cable is its extremely wide bandwidth. The wide bandwidth allows far more communication channels than metallic conductors, and more reliable computer data transmissions at much higher baud rates. In addition, fiber optic cable is smaller and lighter than metallic cable.

There are, however, difficulties with fiber optic cable, which have heretofore prevented its widespread use. The individual fibers, which are bundled to comprise a fiber optic cable, are not much more than the thickness of a human hair, which makes them very difficult to splice together. Splicing two ends of a fiber optic cable entails the tedious and expensive microscopic procedure of aligning the correct individual fibers and splicing them together. It costs about $16,000–$18,000 to splice a 144 fiber cable. Moreover, there is virtually always a signal loss at the splicing junction and this signal loss is particularly difficult to control due to the microscopic size of the fibers and the inability to make a perfectly aligned end-to-end connection. To overcome this signal loss, it is customary to use signal regeneration stations at periodic intervals. Each regeneration station can cost on the order of $350,000 to $400,000, hence, signal loss due to splicing is extremely expensive.

Many fiber optic cable systems are placed underground. Underground fiber optic cable systems typically comprise a network of underground ducts intercepted at strategic locations by manholes. Fiber optic cables often share existing duct work of older electrically conductive transmission cables. In many cases existing electrical cable ducts have been designed with a view towards later expansion. A typical duct comprises a plurality of tubelike passageways or conduits of plastic, metal or concrete extending parallel to one another and opening into manholes.

Placing the fiber optic cable in an underground duct has heretofore proven to be quite difficult due to the comparatively low tensile strength of fiber optic cable. Fiber optic cables are currently manufactured having tensile strengths of 300 pounds, 600 pounds and 1,000 pounds. By comparison, a copper cable has a tensile strength on the order of 5,000 pounds. Due to the fragile nature of fiber optic cable, it is not possible to pull a fiber optic cable through duct work using the techniques employed in pulling copper cable. Hence, the placing of fiber optic cable in underground ducts has heretofore been accomplished by a very labor intensive procedure. According to conventional procedures, the fiber optic cable is pulled using hydraulic powered pinch wheels, similar to conventional V-belt pulleys, which pinch the cable between the pulley groove. To ensure that the cable tensile limits are not exceeded, the prior art procedure requires at least one and usually two workers at each pulley station to feed the cable onto the pulley by hand while watching it carefully for signs of overtensioning. Aside from being labor intensive, the conventional procedure is slow and is difficult to implement when pulling long cable sections. The undesirability of conventional fiber optic cable pulling techniques may be summed up in terms of cost. The procedure is labor intensive, with large attendant labor costs, and places a practical limit on the length of cable sections which can be pulled without breakage, hence, splicing costs and regeneration station costs are also significant.

The present invention solves the aforementioned fiber optic cable placing problems by providing a collapsible and readily transportable cable pulling apparatus which synchronizes the cable pulling speed of several pullers acting in concert and thereby regulates the tension placed on the cable so that it will not break or become internally damaged. The invention provides a generally vertically arranged column having a plurality of legs extending laterally outwardly from and pivotally connected to the column. The legs are adapted for swinging movement in a horizontal plane between a relatively compactly folded position and an outwardly spread position of use. When folded, the cable puller is compact enough to fit through the opening of a manhole and can be easily managed by one or two persons. The cable pulling apparatus further comprises a motor driven cable pulling capstan carried on the column for rotation about a generally horizontal axis. The capstan hub is conical and has a diameter which varies in size along the axis to form a linear ramp or taper between the smaller diameter on one side and the larger diameter on the other side. The capstan is driven through a torque limiter which slips at a predefined limit torque to prevent breakage of the cable.

Further in accordance with the invention, there is provided a cable puller system comprising a plurality of cable pullers as described above which act in concert to coordinate the pulling speed in the various sections of the cable and to regulate the tension throughout the length of the cable being pulled. The individual cable pullers are each driven at substantially the same speed by self-contained motors. One cable puller might be placed at the entrance of a cable duct and a second placed at the exit of the duct. By wrapping the cable at least once around the capstan of each puller, the cable is pulled through the duct by driving forces supplied by the motorized capstans. Frictional forces between the cable and capstan, which are induced by tension in the destination side of the cable, cause the loop portion to ride up the conical incline as tension increases and to slip down the conical incline as tension decreases. The velocity of the cable as it leaves the capstan depends upon the diameter about which the cable is wrapped and the cable will thus ride and slip up and down the capstan until a speed regulating equilibrium is reached. A plurality of cable pullers can thus act in concert and maintain the proper cable speed and tension notwithstanding that sections of the cable may be experiencing different frictional loads due to differences in duct running length.

For a more complete understanding of the invention, its objects and its advantages, reference may be had to the following specification and to the accompanying drawings.

DESCRIPTION OF THE PREFERRED EMBODIMENT

Figure 1:
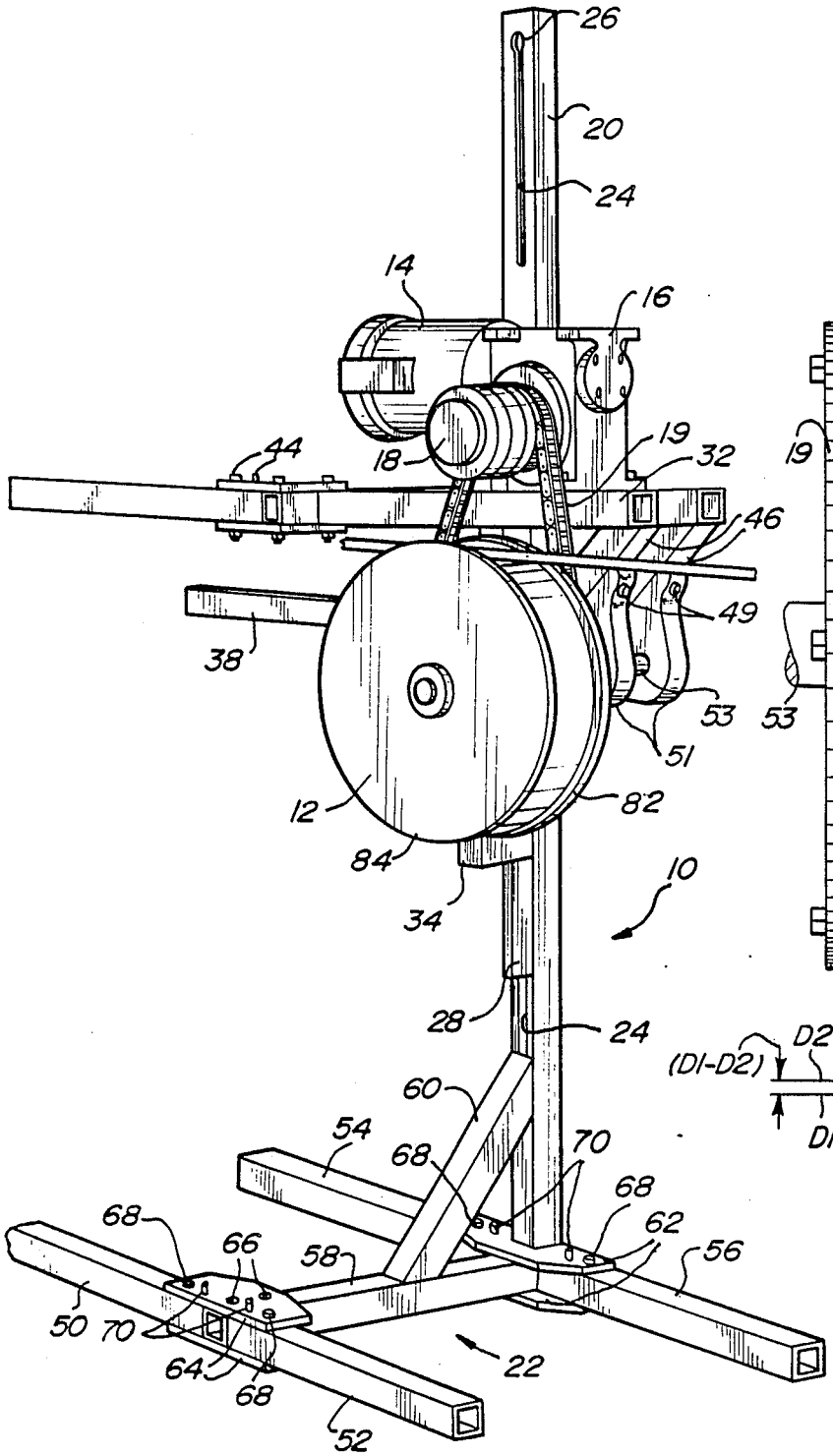
FIG. 1 is a perspective view of the cable puller of the invention in its outwardly spread position of use as seen from the left side thereof.
Figure 2:
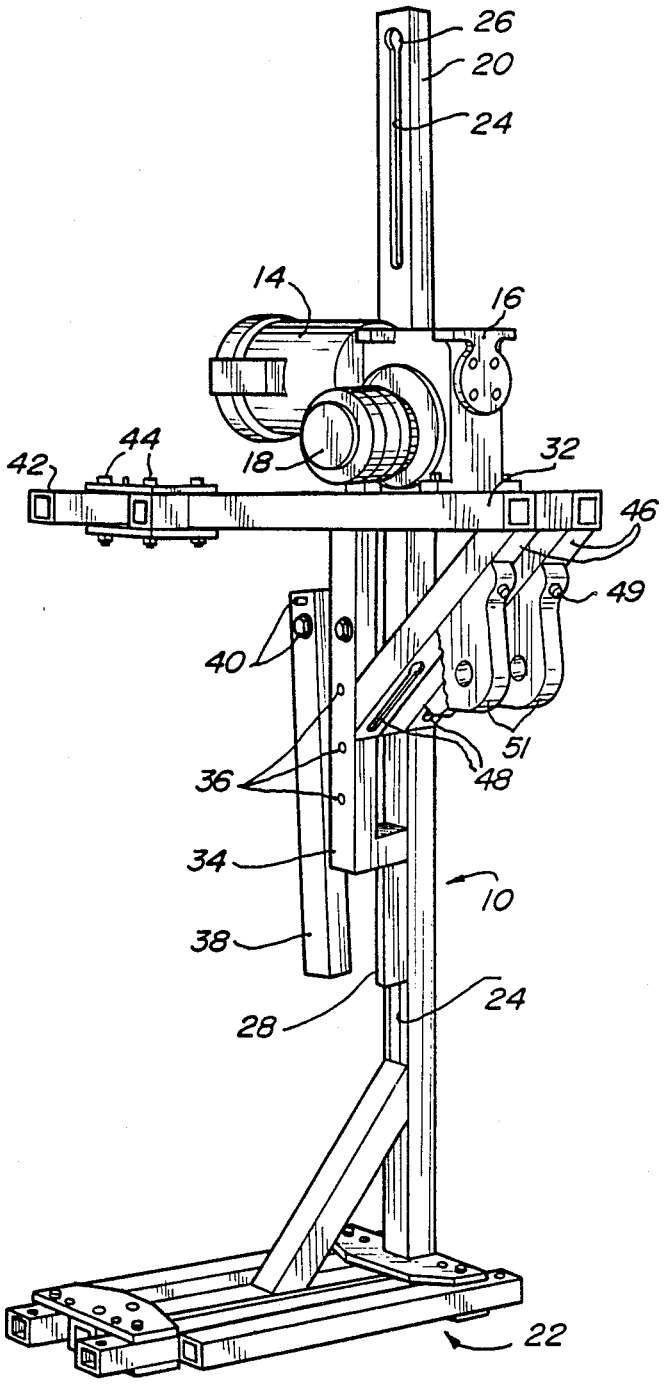
FIG. 2 is a perspective view similar to the view of FIG. 1, showing the cable puller in the compactly folded position.
Figure 3:
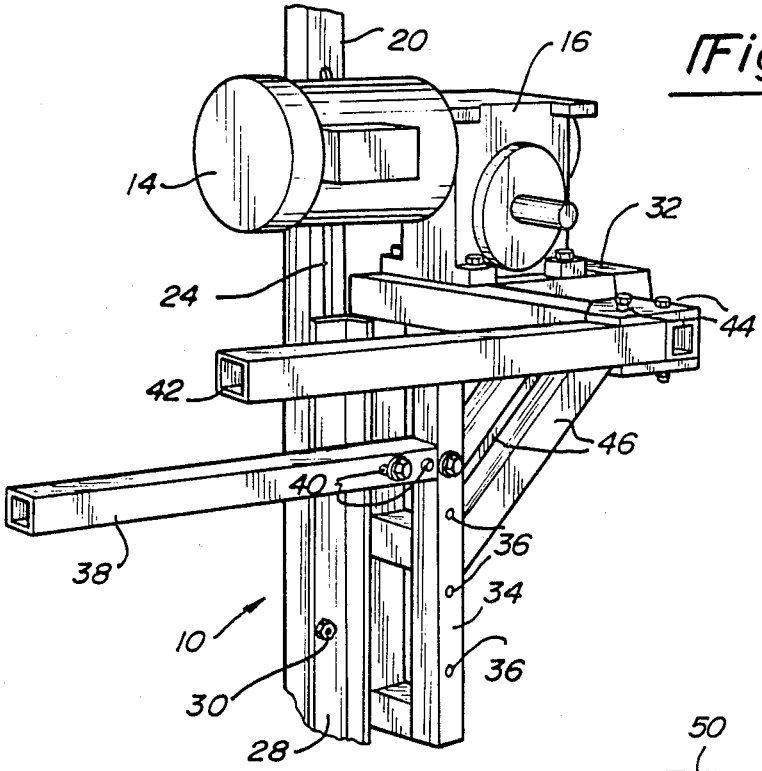
FIG. 3 is a fragmentary left front perspective view of the cable puller in its outwardly spread position and showing the capstan and torque limiter removed.

Referring to FIGS. 1, 2 and 3, the invention comprises a supporting frame 10, carrying a capstan 12. Capstan 12 is driven by motor 14 acting through gear reducer 16, torque limiter 18 and chain drive 19 Motor 14 is preferably a 1½ horsepower, single-phase, 230 volt, capacitor start AC motor. The gear reducer 16 provides a power takeoff at right angles to the motor armature shaft and provides a gear reduction to achieve a nominally 85 ft./sec. cable pulling speed when acting through chain drive 19. Torque limiter 18 is preferably of a type equivalent to the American Autoguard 402 series and may be adjusted to break away at a predetermined maximum pulling force (typically on the order of 550–575 pounds).

The supporting frame is compactly foldable and the entire assembly is lightweight, so that a crew of one or two persons can easily lower the apparatus into an open manhole. The supporting frame 10 is preferably constructed from aluminum stock of hollow rectangular cross section. Frame 10 comprises a generally vertically arranged column 20 secured to a generally horizontal base 22. Column 20 is provided with a plurality of slotted apertures 24 which have an enlarged aperture portion 26 to permit the head of a bolt and washer, or the equivalent, to be inserted into the slotted aperture as a means for mounting the adjustable carriage assembly 28 to the column. Carriage assembly 28 is secured to column 20 using bolts 30 (shown in FIG. 3) which are slidably carried in the slotted apertures 24.

Carriage assembly 28 preferably comprises a portion of angle stock to which a horizontal mounting platform 32 is secured. Secured to the carriage assembly 28 is a generally vertically arranged, outstanding mounting member 34 which has a plurality of vertically spaced holes 36 used in the attachment of a first brace arm 38. First brace arm 38 is secured to the mounting member 34 for pivotal movement between an outwardly extended horizontal position (shown in FIG. 1) and a collapsed vertical position (shown in FIG. 2). Arm 38 is locked in the outwardly extended position by means of a bolt and pin construction illustrated generally at 40. A similar bolt and pin construction is used to lock the legs of base 22 in the outwardly spread position and this bolt and pin construction will be discussed more fully below.

A second brace arm 42 is secured to carriage assembly 28 via bolt and pin construction indicated generally at 44. Brace arm 42 is carried for swinging movement in a generally horizontal plane between the outwardly extending position illustrated in FIG. 1 and the folded position illustrated in FIG. 2. With reference to FIG. 3, second brace arm 42 is shown in the outwardly extended position. The folded position places arm 42 generally adjacent carriage assembly 28 and in or near contact with vertical column 20. Carriage assembly 28 is provided with a pair of angled support braces 46 which are provided with slotted apertures 48 through which bolts 49 are slidably secured to retain capstan mounting yokes 51. Yokes 51 carry capstan axle 53, journaled for rotation about a generally horizontal axis.

The base 22 comprises a left pair of front and rear legs 50 and 52 and a right pair of front and rear legs 54 and 56. Base 22 further comprises a generally horizontal foot member 58 extending at right angles to column 20, and a diagonal brace member 60. The legs 50, 52, 54 and 56, and foot member 58 are secured to column 20 using bracket plates 62 and 64. As illustrated, bracket plates 62 and 64 each comprise a pair of parallel plates having apertures drilled therein for receiving mounting bolts and pins. Column 20 is secured to the uppermost bracket plate 62 as by welding. Foot member 58 is secured between bracket plates 62 and 64 as with bolts 66. The left front and rear legs 50 and 52 are pivotally secured between bracket plates 64, while the right front and rear legs 54 and 56 are pivotally secured between bracket plates 62. Each of the legs is pivotal about mounting bolt 68 and secured in the outwardly spread position by means of a pin 70.

Figure 4A:
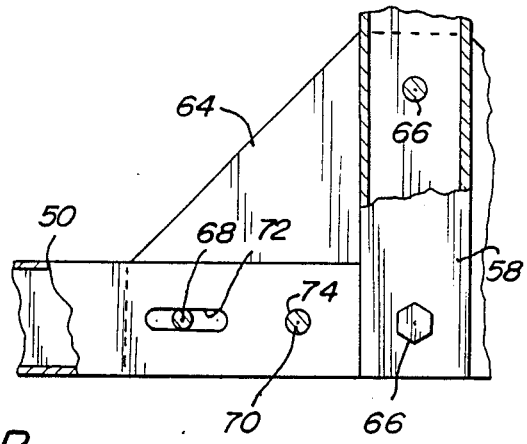
FIGS. 4*a* and 4*b* are cross sectional detailed views of one of the pivoting leg members, showing the slot and hole configuration in the outwardly spread and folded positions respectively.
Figure 4B:
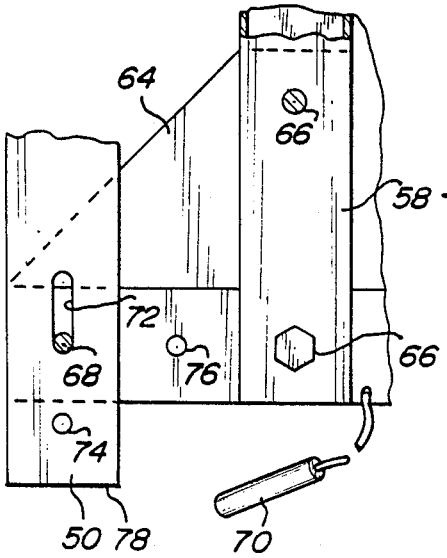

Referring to FIGS. 4A and 4B, the bolt and pin construction of exemplary leg 50 is shown in greater detail. It will be understood that a similar construction is used to secure legs 52, 54 and 56, and also used to secure second brace arm 42 to mounting platform 32. FIG. 4A illustrates leg 50 in the outwardly spread position, while FIG. 4B illustrates leg 50 in the compactly folded position. As illustrated, leg 50 (and also the other legs and brace arm 42) is provided with a slotted aperture 72 and a circular aperture 74. Slotted aperture 72 slidably receives bolt 68 and circular aperture 74 receives pin 70. Pin 70 is shown installed in aperture 74 in FIG. 4A and shown removed from aperture 74 in FIG. 4B. Bracket plate 64 is also provided with a circular aperture 76 for receiving pin 70. When leg 50 is in the outwardly spread position, the butt end 78 is held in place against the side wall of foot member 58. In this position circular apertures 74 and 76 are aligned to receive pin 70. When moving leg 50 to the folded position, pin 70 is removed and the leg is slid outwardly along slotted aperture 72 until butt end 78 is far enough removed from foot member 58 to permit the leg to rotate to the folded position about bolt 68.

Figure 5:
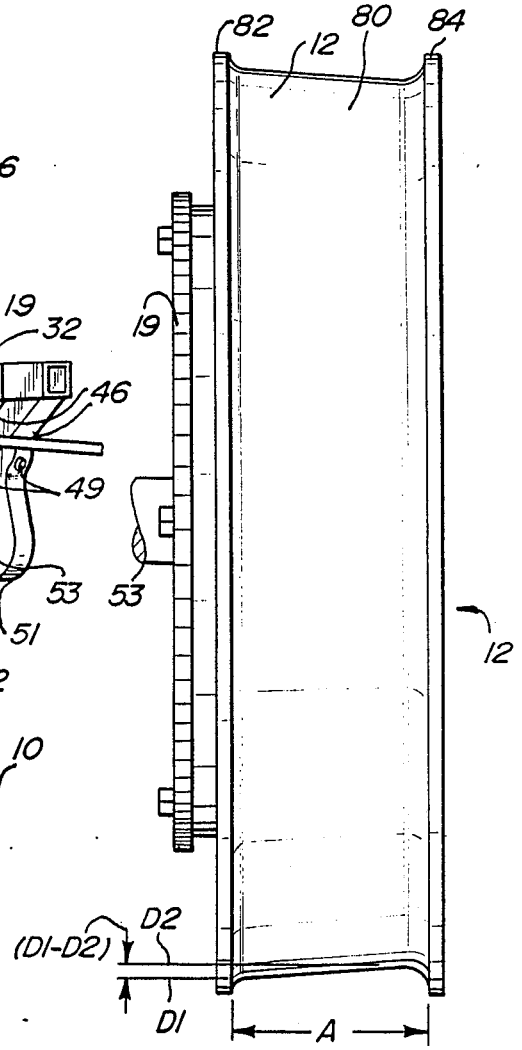
FIG. 5 is a plan view of the capstan.

Referring now to FIG. 5, capstan 12 is illustrated in detail with the large sprocket of chain drive 19 attached as with bolts. Capstan 12 has a conically tapered hub 80 bounded on the inside periphery by inner rim 82 and on the outside periphery by outer rim 84. Preferably, capstan 12 is fabricated from aluminum and machined to a smooth finish on a mill. Hub 80 has a conical taper such that the diameter D1 adjacent inner rim 82 is greater than the diameter D2 adjacent outer rim 84. The diameter varies between these two limits as a linear function of the axial position. Preferably, the larger diameter D1 is on the order of ¾ inches in a 4 inch axial run. Stated differently, the presently preferred taper rises ⅜ inches in radius over a 4 inch axial run. While the ⅜ inch taper is presently preferred, the invention has been demonstrated as operable using radius tapers in a range between slightly greater than 0 and less than ½ inches (i.e. less than a 1 inch diameter change) over a 4 inch axial run. The axial run is indicated at A in FIG. 5, and the change in radius over this run is D1–D2.

The overall diameter of capstan 12 depends upon the load limit of the cable to be pulled. In general, the tensile strength of a fiber optic cable is determined by the cross sectional diameter of the cable and fiber optic cables are supplied with tensile strengths dictated by the cable manufacturer. In addition to tensile strength, fiber optic cables have a minimum bending radius which is also dependent upon the diameter of the cable. As a rule of thumb, a fiber optic cable should not be bent about a radius smaller than twenty times the diameter of the cable. This minimum bending radius puts a constraint on the minimum capstan diameter useable with a given fiber optic cable. In selecting a capstan diameter, the cable manufacturer's specifications should be consulted to determine the minimum bending radius, and the capstan should be selected so that the minimum bending radius is not exceeded when the cable is looped around the capstan in use. Measured from the smaller diameter end D2, the presently preferred embodiment may be implemented using 16 inch, 20 inch, 27 inch and 35 inch diameter capstans. These diameters are selected to correspond to the presently available fiber optic cables, the larger diameter capstans being used with the thicker cables.

Capstan 12 is designed to rotate at a rate to pull cable under tension at a rate of nominally 85 feet per minute, with 120 feet per minute being the upper limit dictated by cable manufacturers. The capstan rotation rate needed to achieve the foregoing cable pulling rate is determined by the nominal diameter of the capstan. The gear reduction ratio of gear reducer 16 and chain drive 19 thus depend upon the armature speed of motor 14 and also upon the desired capstan rotation. Torque limiter 18 is preferably set to break away at or below 600 pounds, as 600 pounds is the most common tensile strength limit dictated by cable manufacturers. To provide a margin of safety, torque limiter 18 is preferably set to brake away at 550–575 pounds.

Figure 6:
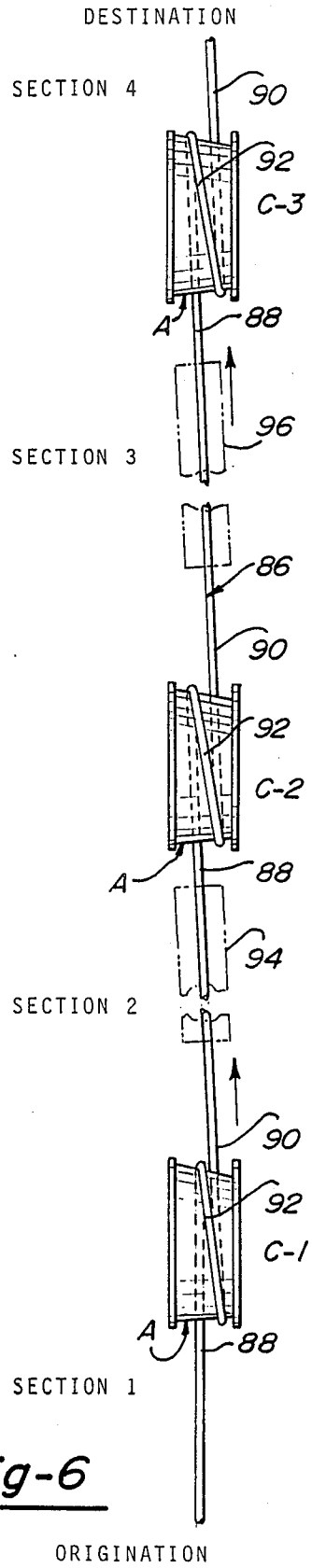
FIG. 6 is a diagrammatic view of a fiber optic cable wrapped around a plurality of capstans in accordance with the inventive method.

In operation a fiber optic cable or pulling rope is wrapped at least 360 degrees around the capstan of one or more cable pullers as illustrated schematically in FIG. 6. In FIG. 6, the cable or pulling rope is indicated at 86 and capstans 12 are illustrated without their associated motors and supporting frames to simplify the illustration. One end of cable 86 is indicated as the "Origination"; the other end of the cable is indicated as the "Destination." Cable movement is in the direction of the arrows indicated in FIG. 6. For identification purposes, the capstans have been denoted by reference designations C-1, C-2 and C-3. Cable 86 may be theoretically endless, although for purposes of understanding the invention, cable 86 may be conceptually subdivided into pull sections designated as section 1, section 2, section 3 . . . as illustrated in FIG. 6. As illustrated, the cable is looped at least once around the capstan, so that the origination side of the cable is wrapped about a larger diameter than the destination side of the cable. The origination side of the cable looped around capstan C-1 is indicated by reference numeral 88 and the destination side by reference numeral 90. The loop portion wrapped around Capstan C-1 is indicated by reference numeral 92. It will be understood that the remaining capstans C-2 and C-3 also have similar cable loop configurations. The cable may be looped more than 360 degrees about a capstan if desired.

The arrangement depicted in FIG. 6 is exemplary of the manner in which a fiber optic cable would be pulled through two successive conduits denoted diagrammatically as conduits 94 and 96. Capstan C-1 is placed at the entrance of conduit 94 and capstan C-2 is placed at the exit of conduit 94 and at the entrance of conduit 96. Capstan C-3 is placed at the exit of conduit 96. To initiate the pulling sequence, a pulling rope or ribbon is first fed through each of the conduit sections manually. Then the end of the fiber optic cable to be pulled is secured to the pulling rope and the pulling rope and fiber optic cable are looped around the capstans as indicated in FIG. 6. Next, the motors of all three capstans are turned on causing all three capstans to rotate at approximately the same speed. The capstans will pull the rope or cable only when there is sufficient tension from the origination and destination sides of the cable to create adequate gripping friction between the cable or rope and surface A denoted in FIG. 6. If no tension is applied from the destination side, the capstan will turn freely and the cable or rope looped therearound will remain stationary or slip to the smaller diameter end of the hub. When tension is applied on the destination side, the capstan will grip the cable and commence pulling the cable.

Accordingly, when tension is applied at the destination side of capstan C-3, the cable grips capstan C-3 and the cable begins to move. This movement causes tension to be placed on section 3 of the cable, thereby placing the destination side of the cable wrapped around capstan C-2 to be placed in tension. This causes capstan C-2 to begin pulling. As the cable in section 2 begins to move under the pulling force of capstan C-2, capstan C-1 is also engaged, whereupon the entire cable is pulled through conduits 96 and 94.

Although all motors are driven at the same speed, the individual cable sections may not require the same pulling force. This is due to the fact that some cable runs may be longer than others and, hence, will require a greater pulling force to overcome frictional losses in the conduit. The invention automatically compensates for differences in required pulling force. When the force required to pull section 2 of the cable is less than the force required to pull section 1, capstan 1 will slip more than capstan 2, resulting in a difference in the rate of cable movement, capstan C-1 moving section 1 slower than capstan C-2 moves section 2. As a result of this difference in moving rate, more friction on capstan C-1 is developed and the cable looped around capstan C-1 climbs to a larger diameter portion of the hub. Having moved to a larger diameter, the cable rate at capstan C-1 increases, thereby compensating for the increased tension in section 2.

In the alternative, if the force required to pull section 2 is greater than the force required to pull section 1, then capstan C-1 will slip less than capstan C-2, resulting in capstan C-1 moving section 1 faster than capstan C-2 moves section 2. As a result of this difference in cable rates, less friction is developed on capstan C-1, and the cable moves to a smaller diameter position on the hub. This causes the cable movement at capstan C-1 to become slower, since the capstan diameter is smaller.

Although not fully understood, the cooperation between fiber optic cable and capstan is believed to be as follows. When tension upon the origination side and destination side is slight, the capstan spins freely without pulling the cable, and the cable looped there around slides down the conical incline toward the smaller diameter end. As tension on the origination and destination sides increases, a point is reached at which the looping portion of the cable develops sufficient friction to grip the capstan, causing the cable to be pulled as the capstan rotates. As long as the cable is looped one full turn (360 degrees) around the capstan, there is a portion of cable from the origination side immediately adjacent to a portion of cable on the destination side. In FIG. 6, these adjacent portions have been shown spaced apart to simplify the illustration. In practice, the adjacent portions of the looped cable are often touching one another, particularly when tension is applied. With the looping portion in gripping contact with the conical hub, the looping portion begins to ride up the conical incline in a spiral fashion similar to the trajectory of the threads of a screw. It has been found that if the looping portion is wrapped more than 360 degrees around the capstan (two full turns, for example) the cable is more responsive to tensions applied to the destination side. With several wraps about the capstan, gripping friction can be established with very slight pulling on the destination side of the cable. This is a particularly advantageous phenomenon, since several wraps may be employed if the cable is abnormally slippery due to cable lubricant, water, mud, ect.

As the cable rides in spiral fashion up the conical incline, the diameter about which the cable is wrapped increases. This increase causes the cable pulling speed to increase, thereby diminishing the tension on the cable (and thus diminishing the gripping friction) assuming that the destination pulling speed does not increase a corresponding amount. At a certain point the cable will have ridden high enough upon the conical incline that gripping friction is lost and the cable slips or remains at a particular diameter unable to climb further. Once this equilibrium is reached, the cable remains at this diameter until the pulling speed changes for whatever reason.

By using a plurality of appropriately spaced cable pullers, it is theoretically possible to pull an endless length of fiber optic cable while maintaining the proper pulling speed across all sections of the cable. When installing the cable pullers at the entrance and exit sides of the duct work or conduit, some attention should be given to positioning the capstan at the proper height and lateral orientation with respect to the conduit so that the cable, when pulled, will enter or exit the conduit without having to make sharp bends. This is quite easily accomplished by adjusting the capstan to the proper height by momentarily loosening the carriage assembly bolts 30. At this time, the entire cable puller should be laterally positioned so that the center of the capstan lines up with the center of the conduit, as shown in FIG. 6. Although this positioning is not extremely critical, the cable may tend to bind or climb over itself if the capstan is positioned too far to the left or right of the center of the conduit. Since the cable may be wrapped more than 360 degrees around the capstan, the invention may be used to direct the cable upwardly through the opening in the top of the manhole by wrapping the cable 90 degrees around the capstan in addition to the first 360 degrees. This makes the invention quite useful for feeding cable from a cable spool located above ground. The adjustable brace arms are placed in contact with the wall of the manhole or against some other stationary structure. The brace arms prevent the puller from tipping or sliding in the direction of the pull.

Because the smaller end of the capstan stands free, it is quite easy to throw a loop of cable around the capstan without having access to the end of the cable. This makes it possible to place an additional loop of cable about the capstan, for greater responsiveness in slippery conditions, while the pulling is taking place. Similarly, it is also possible to remove an extra loop of cable while the puller is operating by simply removing it from the smaller diameter end of the capstan.

Under normal conditions, the cable will be pulled by successive cable pulling stations positioned at strategic locations adjacent the duct work or conduit. If the cable were to encounter excessive friction so that the predetermined tensile breakaway point of torque limiter 18 is reached, the entire system is designed to shut down to prevent cable damage. This is accomplished by means of a radio control circuit (not shown in FIGS. 1, 2 and 3) which may be mounted at any convenient location on the puller. The radio control circuit responds to a fault or stoppage at one or more cable pulling stations by signaling the shut down of the entire system until the fault is corrected and the pullers reset.

Figure 7:
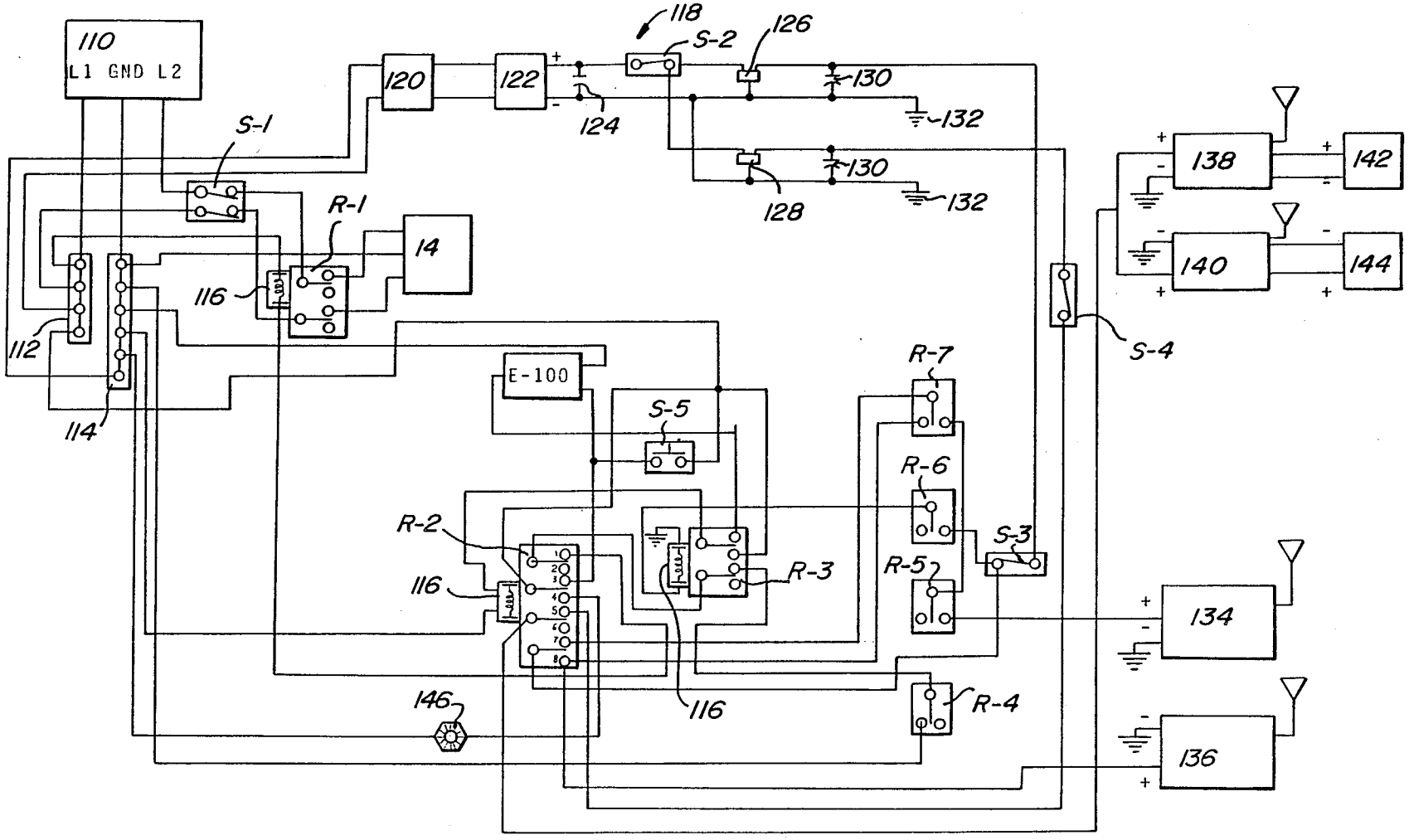
FIG. 7 is an electrical schematic diagram of the radio control mechanism of the invention.

Referring to FIG. 7, the radio control circuit of the invention is illustrated schematically. The electrical circuit is adapted for coupling to a source of alternating current and FIG. 7 depicts this source of current as single-phase power source 110. In the presently preferred embodiment, a 230 volt AC power source is used, providing alternating current terminals L1 and L2 and a ground terminal GND. In the field, power source 110 may be implemented using a portable gasoline powered generator. Of course, other equivalent power sources may also be used. Terminal L1 is coupled to AC bus 112, while the GND terminal is coupled to the ground bus 114. The voltage across terminals L1 and L2 is nominally 230 volts, while the voltage between the AC bus 112 and the ground bus 114 is nominally 117 volts. Power is delivered to motor 14 through motor master switch S-1. Motor master switch makes and breaks both L1 and L2 of the AC line. Connected in series with motor master switch S-1 is the motor master relay R-1. Relay R-1 is controlled by relay coil 116. Motor 14 is also grounded to ground bus 114.

The electrical circuit further comprises a DC power supply which provides both a 12 volt DC output and a 6 volt DC output. The DC power supply is indicated generally at 118, and comprises a step down transformer 120, rectifier 122 and filter capacitor 124. Rectified DC current is switched through 12 volt master switch S-2, which in turn supplies power to 12 volt regulator 126 and 6 volt regulator 128. Both regulators include additional filter capacitors 130 coupled between the regulator output and DC ground indicated at 132. Preferably DC ground 132 is electrically separate from the AC ground at ground bus 114. Twelve volt DC power is supplied to the remainder of the 12 volt circuit through switch S-3. Six volt DC power is supplied to the remainder of the 6 volt circuit through switch S-4. The 12 volt circuit comprises logic relays R-5, R-6 and R-7, and also terminals 7 and 8 of master logic relay R-2. These logic relays make or break the connection of 12 volt power to FM band transmitters 134 and 136, also referred to herein as transmitter 1 and transmitter 2, respectively. The 6 volt circuit comprises terminals 5 and 6 of master logic relay R-2, which makes and breaks the connection of 6 volt electrical power to FM band receivers 138 and 140, also referred to herein as receiver 1 and receiver 2, respectively. Receivers 138 and 140 in turn control indirect drive servos 142 and 144, also referred to herein as servo-1 and servo-2, respectively.

Figure 9:
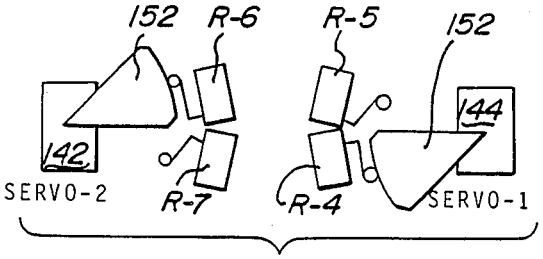
FIGS. 9–11 are diagrammatic views of the state of the radio control servos in various operating states.
Figure 10:
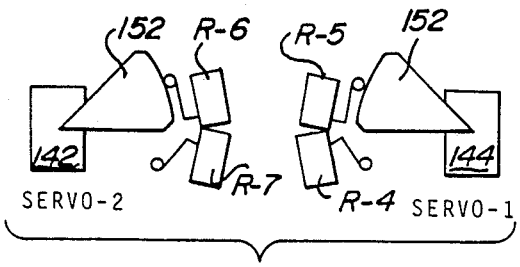
Figure 11:
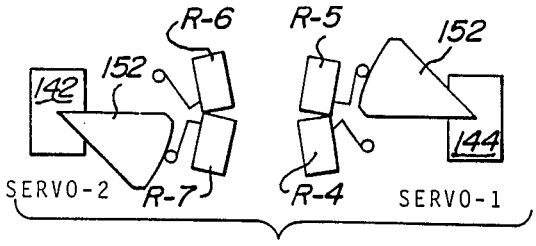

The electrical circuit further comprises alternating current logic circuits for controlling master motor relay R-1 and trip indicator light 146. The AC logic circuit comprises relay R-3, relay R-4 and terminals 1, 2, 3 and 4 of relay R-2. In addition, the AC logic circuit includes a manual reset button S-5 and a motion sensor E-100. Motion sensor E-100 comprises a magnetic sensor 148, seen in FIGS. 1, 2 and 3, which senses periodic magnetic pulses produced by magnet 150 secured to torque limiter 18. Relays R-1, R-2 and R-3 are each activated by relay coils 116 to toggle between first and second states. Relays R-4, R-5, R-6 and R-7 are servo-controlled relays. Relays R-3 and R-4 are controlled by servo 142 (servo-1) and relays R-4 and R-5 are controlled by servo 144 (servo-2). FIGS. 9, 10 and 11 illustrate the manner in which the servos selectively actuate the relays through the action of cam 152. More specifically, FIG. 9 illustrates the servo positions for the prestart-ready position. FIG. 10 depicts the servo positions for the run and internal stop position, while FIG. 11 illustrates the external stop position.

Figure 8:
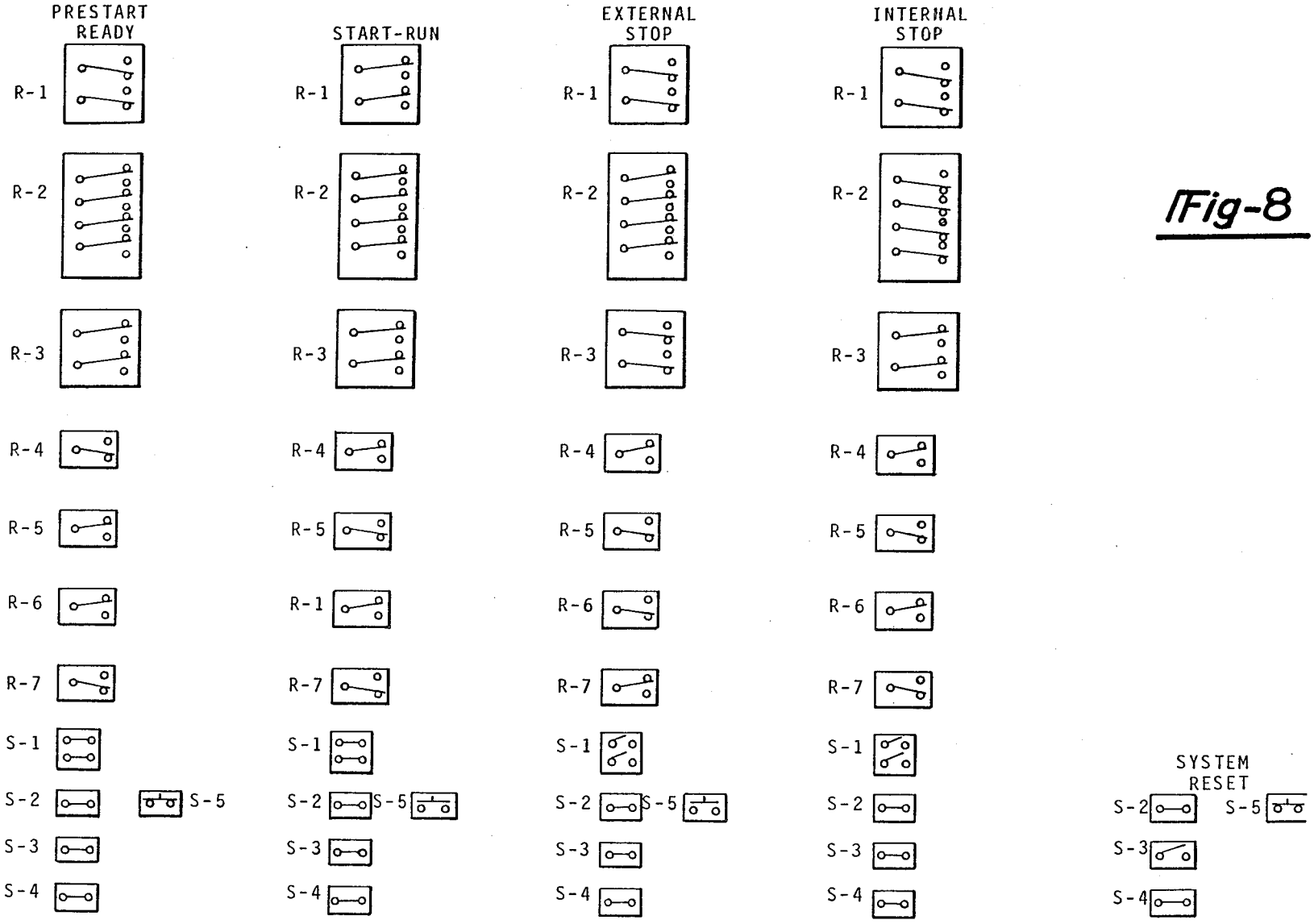
FIG. 8 is a chart indicating the state of various switches and relays of the circuit of the invention useful in understanding the radio control mechanism in operation.

Referring now to FIG. 8, the states of all relays and switches which comprise the circuit of the invention are illustrated for the prestart-ready state, the start-run state, the external stop state and the internal stop state. FIG. 8 also illustrates the system reset condition which is established by manually depressing the reset button S-5 after the cause of the shutdown has been identified and removed. The prestart-ready state represents the normal condition prior to start up. The start-run state is the normal operating state. When a problem occurs at one of the pulling devices, such as excessive cable tension causing torque limiter 18 to break away and stop turning, all pullers in the system must be shut down to prevent cable damage. Thus, each of the pullers is provided with a radio control circuit as illustrated in FIG. 7. The radio control circuits are in communication with one another via FM digital pulse communication through transmit and receive antennas extending out through the manholes. The external stop state depicted in FIG. 8 represents the shutdown condition executed by all of the pullers responding to a shutdown signal from a single puller at the fault situs. The internal stop state represents the condition of the single puller at the fault situs which signalled the shutdown. To aid in identifying the cause of the shutdown, the internal stop condition places terminal 4 of relay R-2 in contact with AC power supplied through motion sensor E-100. This causes trip indicator light 146 to light. The remaining pullers in the system do not energize the trip indicator light, as will be seen by comparing the state of relay R-2 in the external stop state with the same relay in the internal stop state. Hence, only one trip indicator light is lit when a fault occurs, the light associated with the puller located at the fault situs. Once a fault has been detected and the system shuts down, it will remain latched in a shutdown state until the manual reset button is depressed.

Thus, the electrical circuit of the invention provides a radio control circuit for automatically causing a system shutdown when a fault occurs at any puller in the system. The presently preferred embodiments of this circuit is implemented using FM digital pulse transmitter and receiver pairs driving servo-controlled relays. These circuits may be implemented using commercially available model airplane radio controllers. While radio servo-controlled relays are presently preferred for their ruggedness and convenience in engineering and manufacturing, it will be understood that the automatic shutdown circuits may be implemented using other technologies, such as solid-state digital technology. Accordingly, the specific embodiment illustrated herein is not intended to be a limitation upon the scope of the appended claims. Accordingly, while the invention has been described in its presently preferred form, it will be understood that certain modifications and changes may be made without departing from the spirit of the invention as set forth in the appended claims.

What is claimed as novel is as follows:

1. A system for pulling a cable comprising:

a first generally vertically arranged column;

a first means for holding said first column in an upright position;

a first platform means carried on said first column having means for adjustably securing said first platform at various positions along the length of said first column;

a first cable pulling capstan carried on said first platform for rotation about an axis, said first capstan having a conically tapered body, said body being of a dimension enabling axial migration of a cable situated on said first capstan upon a change in tension of said cable, to thereby change the rate of travel of said cable as it is pulled;

a first means supported by said first column for rotationally driving said capstan about said axis;

a second generally vertically arranged column;

a second means for holding said second column in an upright position;

a second platform means carried on said second column having means for adjustably securing said second platform at various positions along the length of said second column;

a second cable pulling capstan carried on said second platform for rotation about an axis, said second capstan having a conically tapered body, said body being of a dimension enabling axial migration of said cable situated on said second capstan upon a change in tension of said cable, to thereby change the rate of travel of said cable as it is pulled; and a second means supported by said second column for rotationally driving said capstan about said axis;

wherein said first and second capstans are so constructed and arranged such that the rate of travel of said cable is substantially uniform as said cable is pulled by said capstans.

2. The cable puller of claim 1 wherein said axis of at least one of said capstans is a generally horizontal axis.

3. The cable puller of claim 1 wherein at least one of said capstans has a diameter which varies in size along said axis.

4. The cable puller of claim 1 wherein at least one of said driving means is an electric motor.

5. The cable puller of claim 1 further comprising a foot member connected to and extending generally orthogonally from at least one of said columns and at least one of said base means being pivotally connected to said foot member.

6. The cable puller of claim 1 further comprising means for adjusting the height of at least one of said capstans.

7. The cable puller of claim 1 further comprising at least one brace arm adjustably secured to at least one of said columns for holding said one column in spaced relation to the wall of a cable conduit structure.

8. The cable puller of claim 1 further comprising means for limiting the torque applied to at least one of said capstans from said driving means.

9. A cable puller comprising:

a generally vertically arranged column;

a means for holding said column in an upright position;

a platform means carried on said column having means for adjustably securing said platform at various positions along the length of said column;

a cable pulling capstan carried on said platform for rotation about an axis, said capstan being cantilevered with respect to said platform to provide ready access to said capstan with any portion of a cable so that the cable may be looped around said capstan;

said capstan having a generally conically tapered body with peripheral rims at both of its ends, having an axis of rotation and having a larger diameter at one peripheral rim than at the other peripheral rim;

said taper of said body being of a dimension such that the diameter of the taper varies between the two peripheral rims as a linear function of axial position enabling axial migration of the cable situated on said capstan upon a change in tension of said cable, to thereby change the rate of travel of said cable as it is pulled; and drive means carried on said platform for rotationally driving said capstan about said axis.

10. The cable puller of claim 9 wherein said column defines an elongated slotted aperture and said platform has means slidable in said slotted aperture for adjustably securing said platform to said column.

11. The cable puller of claim 9 further comprising torque limiting means carried on said platform for limiting the torque applied to said capstan from said driving means.

12. The cable puller of claim 9 wherein said axis is a generally horizontal axis.

13. The cable puller of claim 9 wherein said capstan has a diameter which varys in size along said axis.

14. The cable puller of claim 9 wherein said driving means is an electric motor.

15. The cable puller of claim 9 further comprising at least one brace arm adjustably secured to said column for holding said column in spaced relation to the wall of a cable conduit structure.

16. A cable puller comprising:

a generally vertically arranged column;

a means for holding said column in an upright position;

platform means carried on said column having means for adjustably securing said platform at various positions along the length of said column;

a cable pulling capstan carried on said platform for rotation about an axis, said capstan being cantilevered with respect to said platform to provide ready access to said capstan with any portion of a cable so that the cable may be looped around said capstan;

said capstan having a generally conically tapered body with peripheral rims at both of its ends, having an axis of rotation and having a larger diameter at one peripheral rim than at the other peripheral rim;

said taper of said body being of a dimension such that the diameter of the taper varies between the two peripheral rim as a linear function of axial position enabling axial migration of a cable situated on said capstan upon a change in tension of said cable, to thereby change the rate of travel of said cable as it is pulled;

electric motor drive carried on said platform for rotationally driving said capstan about said axis; and means coupled with said electric motor drive and said capstan for limiting the torque applied to said capstan from said electric motor drive such that the tensile strength in the cable to be pulled is below a desired level.

* * * * *